US010794055B1

(12) United States Patent
Robinson

(10) Patent No.: US 10,794,055 B1
(45) Date of Patent: Oct. 6, 2020

(54) COMPOSITE JOINT SEAL

(71) Applicant: Schul International Co., LLC, Pelham, NH (US)

(72) Inventor: Steven R. Robinson, Windham, NH (US)

(73) Assignee: Schul International Company, LLC, Pelham, NH (US)

( * ) Notice: Subject to any disclaimer, the term of this patent is extended or adjusted under 35 U.S.C. 154(b) by 8 days.

(21) Appl. No.: 16/379,238

(22) Filed: Apr. 9, 2019

(51) Int. Cl.

| | |
|---|---|
| ***E04B 1/68*** | (2006.01) |
| ***E04B 1/61*** | (2006.01) |
| ***E04B 1/94*** | (2006.01) |
| *E04B 2/88* | (2006.01) |
| *E04F 15/02* | (2006.01) |

(52) U.S. Cl.
CPC ..... *E04B 1/6801* (2013.01); *E04B 1/61* (2013.01); *E04B 1/948* (2013.01); *E04B 1/68* (2013.01); *E04B 2/88* (2013.01); *E04B 2001/6818* (2013.01); *E04F 15/02005* (2013.01); *E04F 15/02016* (2013.01)

(58) Field of Classification Search
CPC ..... E04B 1/62; E04B 1/66; E04B 1/68; E04B 1/6806; E04B 1/6807; E04B 1/6812; E04B 1/6813; E04B 1/6815; E04B 1/61; E04B 2001/6818; E04B 2/88; E04B 1/94; E04F 15/02016; E04F 15/02005
See application file for complete search history.

(56) References Cited

U.S. PATENT DOCUMENTS

| | | | | |
|---|---|---|---|---|
| 4,195,850 | A * | 4/1980 | Berger | E04B 1/6812 277/650 |
| 4,719,726 | A * | 1/1988 | Bergman | E04B 1/3211 52/81.4 |
| 4,992,481 | A * | 2/1991 | von Bonin | C09K 3/1021 521/54 |
| 6,282,849 | B1 * | 9/2001 | Tuczek | E04B 1/32 52/648.1 |
| 7,036,277 | B2 * | 5/2006 | Burginger | A63H 33/14 52/79.4 |
| 8,317,444 | B1 | 11/2012 | Hensley | |
| 8,341,908 | B1 | 1/2013 | Lensley et al. | |
| 8,365,495 | B1 | 2/2013 | Witherspoon | |
| 8,739,495 | B1 | 6/2014 | Witherspoon | |
| 8,813,449 | B1 | 8/2014 | Hensley et al. | |
| 8,813,450 | B1 | 8/2014 | Hensley et al. | |
| 8,870,506 | B2 | 10/2014 | Hensley et al. | |
| 9,068,297 | B2 | 6/2015 | Hensley et al. | |
| 9,200,437 | B1 | 12/2015 | Hensley et al. | |
| 9,206,596 | B1 | 12/2015 | Robinson | |
| 9,322,163 | B1 | 4/2016 | Hensley | |
| 9,404,581 | B1 | 8/2016 | Robinson | |
| 9,528,262 | B2 | 12/2016 | Witherspoon | |
| 9,631,362 | B2 | 4/2017 | Hensley et al. | |
| 9,637,915 | B1 | 5/2017 | Hensley et al. | |
| 9,644,368 | B1 | 5/2017 | Witherspoon | |
| 9,670,666 | B1 | 6/2017 | Witherspoon et al. | |

(Continued)

*Primary Examiner* — Phi D A
(74) *Attorney, Agent, or Firm* — Crain, Caton & James, P.C.; James E. Hudson, III

(57) ABSTRACT

The present invention relates generally to systems for creating a joint filler or seal in the gap between adjacent panels or assemblies. The present disclosure is directed to providing an expansion joint seal system which includes a foam associated with a non-foam matrix.

13 Claims, 2 Drawing Sheets

(56) References Cited

U.S. PATENT DOCUMENTS

| | | | |
|---|---|---|---|
| 9,689,157 | B1 | 6/2017 | Hensley et al. |
| 9,689,158 | B1 | 6/2017 | Hensley et al. |
| 9,739,049 | B1 | 8/2017 | Robinson |
| 9,739,050 | B1 | 8/2017 | Hensley et al. |
| 9,745,738 | B2 | 8/2017 | Robinson |
| 9,765,486 | B1 | 9/2017 | Robinson |
| 9,803,357 | B1 | 10/2017 | Robinson |
| 9,840,814 | B2 | 12/2017 | Robinson |
| 9,850,662 | B2 | 12/2017 | Hensley |
| 9,856,641 | B2 | 1/2018 | Robinson |
| 9,951,515 | B2 | 4/2018 | Robinson |
| 9,963,872 | B2 | 5/2018 | Hensley et al. |
| 9,982,428 | B2 | 5/2018 | Robinson |
| 9,982,429 | B2 | 5/2018 | Robinson |
| 9,995,036 | B1 | 6/2018 | Robinson |
| 10,000,921 | B1 | 6/2018 | Robinson |
| 10,060,122 | B2 | 8/2018 | Robinson |
| 10,066,386 | B2 | 9/2018 | Robinson |
| 10,066,387 | B2 | 9/2018 | Hensley et al. |
| 10,081,939 | B1 | 9/2018 | Robinson |
| 10,087,619 | B1 | 10/2018 | Robinson |
| 10,087,620 | B1 | 10/2018 | Robinson |
| 10,087,621 | B1 | 10/2018 | Robinson |
| 10,072,413 | B2 | 11/2018 | Hensley et al. |
| 10,125,490 | B2 | 11/2018 | Robinson |
| 10,179,993 | B2 | 1/2019 | Hensley et al. |
| 10,203,035 | B1 | 2/2019 | Robinson |
| 10,213,962 | B2 | 2/2019 | Robinson |
| 10,227,734 | B1 | 3/2019 | Robinson |
| 10,233,633 | B2 | 3/2019 | Robinson |
| 10,240,302 | B2 | 3/2019 | Robinson |
| 10,280,610 | B1 | 5/2019 | Robinson |
| 10,280,611 | B1 | 5/2019 | Robinson |
| 10,316,661 | B2 | 6/2019 | Hensley et al. |
| 10,323,360 | B2 | 6/2019 | Robinson |
| 10,323,407 | B1 | 6/2019 | Robinson |
| 10,323,408 | B1 | 6/2019 | Robinson |
| 10,323,409 | B1 | 6/2019 | Robinson |
| 10,352,003 | B2 | 7/2019 | Robinson |
| 10,352,039 | B2 | 7/2019 | Robinson |
| 10,358,777 | B2 | 7/2019 | Robinson |
| 10,358,813 | B2 | 7/2019 | Robinson |
| 10,385,518 | B2 | 8/2019 | Robinson |
| 10,385,565 | B2 | 8/2019 | Robinson |
| 10,407,901 | B2 | 9/2019 | Robinson |
| 10,422,127 | B2 | 9/2019 | Hensley et al. |
| 10,480,136 | B2 | 11/2019 | Robinson |
| 10,480,654 | B2 | 11/2019 | Robinson |
| 10,519,651 | B2 | 12/2019 | Hensley et al. |
| 10,533,315 | B2 | 1/2020 | Robinson |
| 10,533,316 | B1 | 1/2020 | Robinson |
| 2011/0179735 | A1* | 7/2011 | Paetrow ..... E04F 15/02011 52/309.1 |
| 2014/0219719 | A1 | 8/2014 | Hensley et al. |
| 2014/0360118 | A1 | 12/2014 | Hensley et al. |
| 2015/0068139 | A1 | 3/2015 | Witherspoon |
| 2017/0130450 | A1 | 5/2017 | Witherspoon |
| 2017/0159817 | A1 | 6/2017 | Robinson |
| 2017/0191256 | A1 | 7/2017 | Robinson |
| 2017/0226733 | A1 | 8/2017 | Hensley et al. |
| 2017/0241132 | A1 | 8/2017 | Witherspoon |
| 2017/0254027 | A1 | 9/2017 | Robinson |
| 2017/0268222 | A1 | 9/2017 | Witherspoon et al. |
| 2017/0292262 | A1 | 10/2017 | Hensley et al. |
| 2017/0298618 | A1 | 10/2017 | Hensley et al. |
| 2017/0314213 | A1 | 11/2017 | Robinson |
| 2017/0314258 | A1 | 11/2017 | Robinson |
| 2017/0342665 | A1 | 11/2017 | Robinson |
| 2017/0342708 | A1 | 11/2017 | Hensley et al. |
| 2017/0370094 | A1 | 12/2017 | Robinson |
| 2018/0002868 | A1 | 1/2018 | Robinson |
| 2018/0016784 | A1 | 1/2018 | Hensley et al. |
| 2018/0038095 | A1 | 2/2018 | Robinson |
| 2018/0106001 | A1 | 4/2018 | Robinison |
| 2018/0106032 | A1 | 4/2018 | Robinison |
| 2018/0119366 | A1 | 5/2018 | Robinison |
| 2018/0142465 | A1 | 5/2018 | Robinison |
| 2018/0148922 | A1 | 5/2018 | Robinison |
| 2018/0163394 | A1 | 6/2018 | Robinison |
| 2018/0171564 | A1 | 6/2018 | Robinison |
| 2018/0171625 | A1 | 6/2018 | Robinison |
| 2018/0202148 | A1 | 7/2018 | Hensley et al. |
| 2018/0238048 | A1 | 8/2018 | Robinison |
| 2018/0266103 | A1 | 9/2018 | Robinson |
| 2018/0274228 | A1 | 9/2018 | Robinson |
| 2018/0300490 | A1 | 10/2018 | Robinson |
| 2018/0363292 | A1 | 12/2018 | Robinson |
| 2018/0371746 | A1 | 12/2018 | Hensley et al. |
| 2018/0371747 | A1 | 12/2018 | Hensley et al. |
| 2019/0057215 | A1 | 2/2019 | Robinson |
| 2019/0063608 | A1 | 2/2019 | Robinson et al. |
| 2019/0071824 | A1 | 3/2019 | Robinson |
| 2019/0107201 | A1 | 4/2019 | Robinson |
| 2019/0108351 | A1 | 4/2019 | Robinson |
| 2019/0194880 | A1 | 6/2019 | Robinson |
| 2019/0194935 | A1 | 6/2019 | Robinson |
| 2019/0211546 | A1 | 7/2019 | Hensley et al. |
| 2019/0242070 | A1 | 8/2019 | Robinson |
| 2019/0242117 | A1 | 8/2019 | Robinson |
| 2019/0242118 | A1 | 8/2019 | Robinson |
| 2019/0249420 | A1 | 8/2019 | Robinson |
| 2019/0249421 | A1 | 8/2019 | Robinson |
| 2019/0249422 | A1 | 8/2019 | Robinson |
| 2019/0249423 | A1 | 8/2019 | Robinson |
| 2019/0266335 | A1 | 8/2019 | Robinson |
| 2019/0271150 | A1 | 9/2019 | Robinson |
| 2019/0271151 | A1 | 9/2019 | Robinson |
| 2019/0323347 | A1 | 10/2019 | Hensley et al. |
| 2020/0018061 | A1 | 1/2020 | Robinson |

* cited by examiner

COMPOSITE JOINT SEAL

CROSS-REFERENCE TO RELATED APPLICATIONS

None.

STATEMENT REGARDING FEDERALLY SPONSORED RESEARCH OR DEVELOPMENT

Not Applicable.

BACKGROUND

Field

The present disclosure relates generally to systems for crating a joint filler or seal in the gap between adjacent panels or assemblies. More particularly, the present disclosure is directed to providing an expansion joint seal system which includes a foam associated with a non-foam matrix.

Description of the Related Art

Construction panels and other assemblies come in many different sizes and shapes and may be used for various purposes, including curtain wall, aluminum and glass panels, roadways, sideways, tunnels and other pre-cast structures. Because of the effects of the co-efficient of thermal expansion between similar and dissimilar materials, and external forces such as wind and seismic movement, it is necessary to form a lateral gap or joint between adjacent panels, buildings, or building sections to allow for independent movement. These gaps are also used to permit moisture to be collected and expelled. Cavity walls are common in masonry construction, typically to allow for water or moisture to condense or accumulate in the cavity or space between the two exterior walls. Collecting and diverting moisture from the cavity wall construction can be accomplished by numerous well-known systems. The cavity wall is often ventilated, such as by brick vents, to allow air flow into the cavity wall and to allow the escape of moisture heat or humidity. In addition to thermal movement or seismic joints in masonry walls, control joints are often added to allow for the known dimensional changes in masonry over time. Curtain wall or rain screen design is another common form of exterior cladding similar to a masonry cavity wall. Curtain walls can be designed to be primarily watertight but can also allow for the collection and diversion of water to the exterior of the structure. A cavity wall or curtain wall design cannot function as intended if the water or moisture is allowed to accumulate or condense in the cavity wall or behind a curtain wall or rain screen design cannot be diverted or redirected back to the outside of the wall. If moisture is not effectively removed it can cause damage ranging from aesthetic in the form of white efflorescence buildup on surface to mold and major structural damage from freeze/thaw cycling.

Thus, expansion and movement joints are a necessary part of all areas of construction. The size and location of the movement depends on variables such as the amount of anticipated thermal expansion, load defection and any expected seismic activity. Joint movement in a structure can be cyclical in design as in an expansion joint or in as a control joint to allow for the shrinkage of building components or structural settling. These movement joints serve an important function by allowing a properly designed structure to move and the joints to cycle over time and to allow for the expected dimensional changes without damaging the structure. Expansion, control and movement joints are found throughout a structure from the roof to the basement, and in transitions between horizontal and vertical planes. It is an important function of these expansion joints to not only move as intended but to remain in place through their useful lifespan. This is often accomplished by extending the length and/or width of the expansion joint system over or past the edge of the gap or joint opening to attach to the joint substrate or another building component. Examples of building components that would ideal to integrally join an expansion joint with and seal would be, although not limited to, waterproofing membranes, air barrier systems, roofing systems and transitions requiring the watertight diversion of rain water. Although these joints represent only a small percentage of the building surface area and initial cost, they often account for a large percentage of waterproofing, heat loss, moisture/mold problems and other serious interior and exterior damage during the life of the building.

Conventional joint sealants like gunnable sealants and most foam seals are designed to hold the water out of the structure or expansion joint. However, water can penetrate the joint substrate in many ways such as cracks, poor sealant installation, roofing details and a porous substrate or wall component. When water or moisture enters the wall the normal sealing function of joint sealant may undesirably retain the moisture in the wall. Foam joint seals known in the art typically rely on the application of an elastomer sealant on the primary or exposed face of foam to provide the water-resistant function. Such joint seals are not waterproof, but retard the penetration of water into the joint by providing a seal between adjacent substrates for a time and under a maximum pressure. Particularly, such joint seals are not waterproof—they do not preclude water penetration under all circumstances. While this is helpful initially to keep water out of the joint and structure it does not allow for this penetrating water or moisture to escape.

Further complicating operation, some wall designs, such as cavity walls, allow for moisture to enter a first wall layer where it collects and is then directed to the outside of the building by flashing and weep holes. In these systems, water can sometimes be undesirably trapped in the cavity all, such as at a mortar bridge in the wall, or other impediment caused by poor flashing selection, design or installation. When a cavity wall drainage system fails, water is retained within the structure, leading to moisture accumulating within in the wall, and to an efflorescence buildup on the exterior of the wall. This can also result in freeze-thaw damage, among other known problems.

To be effective in this environment, fully functional, foam-based joint seals require a minimum compression ratio. It is known that higher densities and ratios can provide addition sealing benefits. Cost, however, also tends to increase with overall density. There is ultimately a trade-off between compression ratio/density range and reasonable movement capabilities at about 750 kg/m$^3$. As can be appreciated, this compressed density is a product of the uncompressed density of the material and the desired compression ratio to obtain other benefits, such as water resistance. For example, a foam having an uncompressed density of 150 kg/m$^3$ uncompressed and compressed at a 5:1 ratio results in a compressed density of 750 kg/m$^3$. Alternative compressed densities and compression ratios may reach that compressed density of 750 kg/m$^3$ while producing different mechanical properties. It has been long known in the art that a functional foam expansion joint sealant can be constructed using a foam having an impregnation which, when uncompressed, has a density range of about 80 kg/m$^3$, which is used at a 5:1 compression ratio, resulting in a compressed density of 400 kg/m$^3$. Various impregnations are known in the art, including binders, fillers, fire-retardant impregnations, water retarding impregnations, and water reactive impregnations. Alternatively, materials may be introduced by infusion, being put into, or being included in the foam. As a further alternative, the materials may be provided as a coating. This functional foam expansion joint sealant is capable of maintaining position within a joint and its profile while accommodating thermal and seismic cycling, while providing effective sealing, resiliency and recovery. Such joint seals are not fireproof, but retard the penetration of fire into the joint by providing a seal which protects the adjacent substrates or the base of the joint for a time and under a maximum temperature. Particularly, such joint seals are not fireproof—they do not preclude the burning and decomposition of the foam when exposed to flame.

Another alternative known in the art for increasing performance is to provide a foam impregnated with a water-resistant material at a density in the range of 120-160 kg/m$^3$, ideally at 150 kg/m$^3$ for some products, with a mean joint size compression ratio of about 3:1 with a compressed density in a range of about 400-450 kg/m$^3$, although densities in a broader range, such as 45-710 kg/m$^3$ uncompressed and installed densities, after compression and installation in the joint, of 45 kg/m$^3$ and 1500 kg/m$^3$ may also be used. These criteria ensure excellent movement and cycling while providing for fire resistance according to DIN 4112-2 F120, meeting the Conditions of Allowance under UL 2079 for a two-hour endurance, for conventional depth, without loading, with one or more movement classifications, for a joint not greater than six inches and having a movement rating as great as 100%, without a hose stream test, and an ASTM E-84 test result with a Flame Spread of 0 and a Smoke Index of 5. This density range is well known in the art, whether it is achieved by lower impregnation density and higher foam compression or higher impregnation density and a lower compression ratio, as the average functional density required for an impregnated open cell foam to provide sealing and other functional properties while allowing for adequate joint movement up to +/−50% or greater. Foams having a higher uncompressed density may be used in conjunction with a lower compression ratio, but resiliency may be sacrificed. As the compressed density increases, the foam tends to retard water more effectively and provides an improved seal against the adjacent substrates. Additives that increase the hydrophobic properties or inexpensive fillers such as calcium carbonate, silica or alumina hydroxide (ATH) provided in the foam can likewise be provided in a greater density and become more effective. Combustion modified foams such as a combustion modified flexible polyurethane foam, combustion modified ether (CME) foam, combustion modified high resilience (CMHR) foam or combustion modified Viscoelastic foam (CMVE) can be utilized in the preferred embodiments to add significant fire resistance to the impregnated foam seal or expansion joint without adding additional fire-retardant additives. Foam that is inherently fire resistant or is modified when it manufacture to be combustion or fire-resistant reduces the cost of adding and binding a fire retardant into the foam. This method has been found to be advantageous in allowing fire resistance in foam seals configured in very high compression ratios such as 5:1 and higher.

By selecting the appropriate additional component, the type of foam, the uncompressed foam density and the compression ratio, the majority of the cell network will be sufficiently closed to impede the flow of water into or through the compressed foam seal thereby acting like a closed cell foam. Beneficially, an impregnated or infused open cell foam can be supplied to the end user in a pre-compressed state in rolls/reels or sticks that allows for an extended release time sufficient to install it into the joint gap. To further the sealing operation, additional components may be included. For example, additives may be fully or partially impregnated, infused or otherwise introduced into the foam such that at least some portion of the foam cells are effectively closed, or a hydrophobic or water-resistant coating is applied. However, the availability of additional components may be restricted by the type of foam selected. Closed cell foams which are inherently impermeable for example, are often restricted to a lower joint movement range such as +/−25% rather than the +/−50% of open celled foams. Additionally, the use of closed cell foams restricts the method by which any additive or fillers can be added after manufacture. Functional features such as fire resistance to the Cellulosic time-temperature curve for two hours or greater can be however be achieved in a closed cell foam seal without impacting the movement properties. Intumescent graphite powder added to a polyethylene (PE), ethylene vinyl (EVA) acetate or other closed cell foam during processing in a ratio of about 10% by weight has been found to be a highly effective in providing flexible and durable water-and-fire-resistant foam seal. While intumescent graphite is preferred, other fire retardants added during the manufacture of the closed cell foam are anticipated and the ratio of known fire retardants, added to the formulation prior to creating the closed cell foam, is dependent on the required fire resistance and type of fire retardant. Open celled foams, however, present difficulties in providing water-resistance and typically require impregnation, infusion or other methods for introducing functional additives into the foam. The thickness of a foam core or sheet, its resiliency, and its porosity directly affect the extent of diffusion of the additive throughout the foam. The thicker the foam core or sheet, the lower its resiliency, and the lower its porosity, the greater the difficulty in introducing the additive. Moreover, even with each of these at optimum, the additive will likely not be equally distributed throughout the foam, but will be at increased density at the inner or outer portions depending on the impregnation technique.

A known solution in the art is the use of foam segments bonded together laterally to provide a lamination. However, such lateral laminations can separate from one another, creating fissures and openings for contaminates. Moreover, because the laminations are laterally positioned, the resulting pressure exerted by the joint seal against the adjacent substrates is a function of the combined densities and thicknesses and is constant at all heights of the substrate wall.

It is also known that the thin built-up lateral laminations must be adhesively bonded to avoid separation, and therefore failure, under thermal shock, rapid cycling or longitudinal shear. Because of the cost to effectively bond the lateral laminations, a cost/performance assessment sometimes produces laminations loosely held together by the foam compression rather than by an adhesive. While this is known in the art to be somewhat effective in low performance applications and OEM assembly uses, it also known that it cannot meet the demands of high movement seismic, shear, deflection joints or where fail-safe performance is required. In light of these issues, the preferred embodiment for a high movement impregnated foam expansion joint has been found to instead be a monolithic foam design comprised of a single impregnated foam core. However, lamination systems may be desirable when the structure includes a functional component between the laminations such as a water-resistant membrane or a fire-resistant layer.

Construction of lamination systems have typically been lateral composites considered undesirable or inferior for a high movement or rapid cycling fire-resistant expansion joint sealant. The higher compression ratios and greater volumes of fire-retardant additives are likely to cause the foam to fatigue more rapidly and to lose much of its internal recovery force. This proves problematic over time due to the anticipated exposure to movement and cycling as the impregnated foam will tend to lose its recovery force and rely more on the push-pull connection to the joint substrate. When foam laminations are vertically-oriented, the laminations can de-bond or de-laminate and separate from one another, leading to only the outer most lamination remaining attached to the joint substrate, resulting in the laminated foam joint sealant ceasing to provide either water, air or fire resistance.

A known alternative or functional supplement to the use of various impregnation densities and compression ratios is the application of functional surface coatings such as water-resistant elastomers or fire-resistant intumescents, so that the impregnated foam merely serves as a "resilient backer". Almost any physical property available in a sealant or coating can be added to an already impregnated foam sealant layering the functional sealant or coating material. Examples would include but not limited to, fire ratings, waterproofing, color, UV resistance, mold and mildew resistance, soundproofing, impact resistance, load carrying capacity, faster or slower expansion rates, insect resistance, conductivity, chemical resistance, pick-resistance and other known to those skilled in the art. For example, a sealant or coating having a rating or listing for Underwriters Laboratories 2079 may be applied to an impregnated compressed foam to create a fire-resistant foam sealant.

One approach to addressing the shortcomings has been the creation of composite materials, where the foam core—whether solid or composed of laminations of the same or differing compositions—is coated or surface impregnated with a function layer, so that the foam is merely a resilient backer for the sealant, intumescent or coating, such that the composition and density become less important. These coatings, and the associated properties, may be adhered to the surface of each layer of a core or layered thereon to provide multiple functional properties. As can be appreciated, the composite material may have different coatings applied the different sides to provide desired property or properties consistent with its position. Functional coatings such a water-resistant sealant can protect the foam core from absorbing moisture even if the foam or foam impregnation is hydrophilic. Similarly, a functional coating such as a fire-rated sealant added to the foam core or lamination with protect a foam or foam impregnation that is flammable. A biocide may even be included. This could be layered, or on opposing surfaces, or—in the case of a laminate body—on perpendicular surfaces.

Additionally, it has become desirable, and in some situations required, for the joint sealant system to provide not only water resistance, but also fire resistance. A high degree of fire resistance in foams and impregnated foam sealants is well known in the art and has been a building code requirement for foam expansion joints in Europe for more than a decade. Fire ratings such as UL 2079, DIN 4112-2, BS 476, EN1399, AS1503.4 have been used to assess performance of expansion joint seals, as have other fire resistance tests and building codes and as the basis for further fire resistance assessments, the DIN 4112 standard, for example, is incorporated into the DIN 18542 standard for "Sealing of outside wall joints with impregnated sealing tapes made of cellular plastics—Impregnated sealing tapes." While each testing regime utilizes its own requirements for specimen preparation and tests (water test, hose stream tests, cycling tests), the 2008 version of UL 2079, the ISO 834, BS 476; Part 20, DIN 4112, and AS 1530.4-2005 use the Cellulosic time/temperature curve, based on the burning rate of materials found in general building materials and contents, which can be described by the equation T=20+345*LOG(8*t+1), where t is time in minutes and T is temperature in C. While differing somewhat, each of these testing regimes addresses cycling and water resistance, as these are inherent in a fire-resistant expansion joint. The fire resistance of a foam sealant or expansion has been sometimes partially or fully met by infusing, impregnating or otherwise putting into the foam a liquid-based fire retardant, such as aluminum trihydrate or other fire retardants commonly used to add fire resistance to foam. Unfortunately, this increases weight, alters the foam's compressibility, and may not provide the desired result without additional fire-resistant coatings or additives if a binder, such as acrylic or polyurethane, is selected to treat the foam for fire and water resistance. Doing so while maintaining movement properties may affect the foam's compressibility at densities greater than 750 kg/m$^3$. Ultimately, these specialty impregnates and infused compositions increase product cost.

It has further become desirable or functionally required to apply a fire-resistant coating to the foam joint systems to increase fire and water resistance, but often at the sacrifice of movement. Historically, fire-resistant foam sealant products that use an additional fire-resistant surface coating to obtain the life safety fire properties have been limited to only +/−25% movement capability, especially when required to meet longer time-temperature requirements such as UL2079's 2 hour or longer testing. This +/−25% movement range is too limited for most movement joints and would not meet most seismic movement and expansion joint requirements. One well-known method for utilizing these low movement fire-resistant joint sealants is to increase the width or size of the joint opening, an undesirable and expensive alternative, to allow for a commonly required +/−50% joint movement rating.

It would be an improvement to the art to provide an expansion joint seal which provides full or variable levels of resistance to water, air, sound, impact and potentially to flame, retains compressibility over time, provided separate body members which may provide different or a combination of properties and which each maintain a density value across the joint, and which may only optionally include impregnating, infusing or compression forcing a large amount of solid fillers into the foam structure.

SUMMARY

The present disclosure therefore meets the above needs and overcomes one or more deficiencies in the prior art. The disclosure provides an expansion joint seal with an elastic and resilient rectangular prism body and a thin, flexible non-foam member. The elastic and resilient rectangular prism body has a rectangular prism body top surface, a rectangular prism body bottom surface opposite the rectangular prism body top surface, a rectangular prism height from the rectangular prism body bottom surface to the rectangular prism body top surface, a rectangular prism body first side surface, a rectangular prism body second side surface opposite the rectangular prism body first side surface, a rectangular prism body width from the rectangular prism body second side surface to the rectangular prism body first side surface, a rectangular prism body front surface, a rectangular prism body rear surface opposite the rectangular prism body front surface, and a rectangular prism body length from the rectangular prism body rear surface to the rectangular prism body front surface. The rectangular prism body may have a plurality of prism members where each of the prism members may have a prism body length equal to the rectangular prism body length, a prism body width less than the rectangular prism body width, and a thin, flexible non-foam member intermediate each of the plurality of nonrectangular prism members. The non-foam member may have a non-foam member length rectangular prism body, the non-foam member adhered to each of the plurality of nonrectangular prism members. The thin, flexible non-foam member is intermediate each of the plurality of nonrectangular prism members.

Additional aspects, advantages, and embodiments of the disclosure will become apparent to those skilled in the art from the following description of the various embodiments and related drawings.

BRIEF DESCRIPTION OF THE DRAWINGS

So that the manner in which the described features, advantages, and objects of the disclosure, as well as others which will become apparent, are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DETAILED DESCRIPTION

The present disclosure provides an expansion joint system. As can be appreciated, sealants, coatings, functional membranes, adhesives and other functional materials may be applied to or included within the components of the disclosure.

Figure 1:
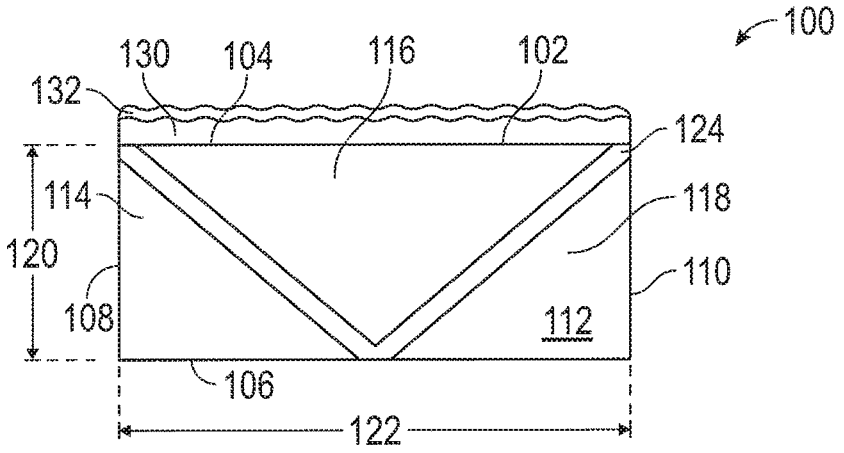
FIG. 1 illustrates an end view of a joint seal system according to the present disclosure.

Referring to FIG. 1, an illustration is provided of an end view of a joint seal system according to the present disclosure. The expansion joint seal 100 includes an elastic and resilient, rectangular prism body 102 which may have plurality of prism members 114, 116, 118, and a thin, flexible non-foam member 124 intermediate each of the plurality of nonrectangular prism members 114, 116, 118.

Figure 5:
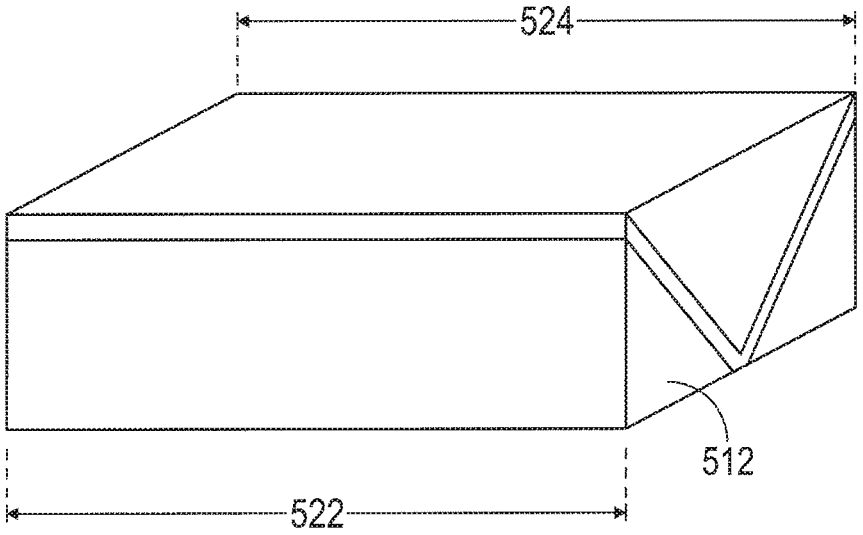
FIG. 5 illustrates an isometric view of the expansion joint seal from the rear and side according to the present disclosure.

The rectangular prism body 102 has a height, width and length. The rectangular prism body 102 has a rectangular prism body top surface 104, a rectangular prism body bottom surface 106 opposite the rectangular prism body top surface 104, and a rectangular prism height 120 from the rectangular prism body bottom surface 106 to the rectangular prism body top surface 104. The rectangular prism body 102 further has a rectangular prism body first side surface 108, a rectangular prism body second side surface 110 opposite the rectangular prism body first side surface 108, and a rectangular prism body width 122 from the rectangular prism body second side surface 110 to the rectangular prism body first side surface 108. Referring to Fig. and to FIG. 5, an isometric illustration of the expansion joint seal 100 from the rear and side, the rectangular prism body 102 also has a rectangular prism body front surface 112, a rectangular prism body rear surface 512 opposite the rectangular prism body front surface 112, and a rectangular prism body length 522 from the rectangular prism body rear surface 512 to the rectangular prism body front surface 112.

Similarly, each of the prism members 114, 116, 118 has a length, width and height, constrained by inclusion in the rectangular prism body 102. The prism members may be of any shape and may be a rectangular prism. Referring to FIG. 1, the plurality of prism members 114, 116, 118 includes a first triangular prism member 114, a second triangular prism member 116 and a third prism member 118. The prism members 114, 116, 118 fit to the non-foam member 124 and may have a v-shaped profile to form the rectangular prism body 102. Each of the prism members 114, 116, 118 has a prism body length 524 equal to rectangular prism body length 522, a prism body width less than the rectangular prism body width 122, the non-foam member 124 may have a non-foam member length rectangular prism body, the non-foam member 124 adhered to each of the plurality of nonrectangular prism members 114, 116, 118.

The prism members 114, 116, 118 may be a foam member or may be a non-foam material which exhibits similar properties of compressibility, expansion, resiliency, and to support liquid-based additives, such a fire retardants and fillers, each of which may have its own spring force. This may be a foam, a corn starch-based material, cellulose or other compressible material. Each prism member should preferably be composed of an elastically compressible, though materials which are not elastic and/or not compressible may be used. Each of the prism members 114, 116, 118 has body specific properties, including density and spring force, which may be common or dissimilar. Each of the prism members 114, 116, 118 may have common or dissimilar or unequal properties which affect sound damping, including cell size, tortuosity, and porosity. Similarly, each prism member has a density, where the prism member densities may be unequal.

One or more of the prism members 114, 116, 118 may have one or more internal voids in communication with at least one of a prism member first surface, a prism member second surface, a prism member bottom surface, a prism member top surface, a prism member front surface, and a prism member rear surface, where at least one quarter of the internal voids have a fire-retardant material therein.

The intended compression, a reduction in a width, of a prism member 114, 116, 118 may be coupled with the spring force of that particular core body and the thickness of that body to provide a force to be applied by that body to packaging for shipment and to substrates after installation.

The resulting force by each of the prism members 114, 116, 118 may be equal, nearly equal or of different values as desired.

The expansion joint seal 100 may be provided with end profiles intended to provide interlocking faces so a plurality of expansion joint seal 100 may be installed in abutment.

The expansion joint seal 100 includes rectangular prism body front surface 112 which may have a joint first end profile and a rectangular prism body rear surface 512 which may have a joint seal second end profile, where the joint seal first end profile and the joint seal second end profile are complementary, such as where one of the prism members 114, 116, 118 is offset from the others, and thereby provides a key which interlocks with the adjacent expansion joint seal 100. Alternatively, the joint seal first end profile may be a flat end.

The thin, flexible non-foam member 124 may be composed of any non-foam material including plastics, rubber, and similar materials which provide resiliency, structural support, and flexibility, and therefore may have its own spring force. The thin, flexible non-foam member 124 may be constructed in any shape, but preferably so the thin, flexible non-foam member 124 extends from the rectangular prism body first side surface 108 to, the rectangular prism body second side surface 110 with a deflection or change of direction within to facilitate a change in shape as the extent of compression of the expansion joint seal 100 by the adjacent substrates changes. As illustrated in FIG. 1, the thin, flexible non-foam member 124 may be a simple vee shape, oriented downward, but may also be oriented upwards.

The non-foam member 124 may have a non-foam member thickness not greater than 10 percent of the rectangular prism body width. The non-foam member 124 is composed of a material selected from the group consisting of a permeable material, an impermeable material, a rubber material, a hydrophilic material, a hydrophobic material, a fire-retardant material.

A first fire-retardant coating 130 may be applied adjacent the rectangular prism body top surface 104. The first fire-retardant coating 130 is selected to provide a substance that slows the spread of fire. The first fire-retardant coating 130 may undergo chemical reaction when heated to reduce flammability or delay combustion or cool through physical action or endothermic reactions. The first fire-retardant coating 130 may provide retardancy through endothermic degradation, such as by use of aluminum hydroxide. The first fire-retardant coating 130 may provide retardancy through thermal shielding, such as by use of an intumescent, which chars over when burned, separating the flame from the material and slowing heat transfer. The first fire-retardant coating 130 may provide retardancy by gas phase radical quenching, such as when chlorinated paraffin undergoes thermal degradation and releases hydrogen chloride to lower potential propagation of combustion reactions. The first fire-retardant coating 130 may extend to one or more of the rectangular prism body first side surface 108, the rectangular prism body second side surface 110, the rectangular prism body front surface 112, and the rectangular prism body rear surface 512.

Figure 2:
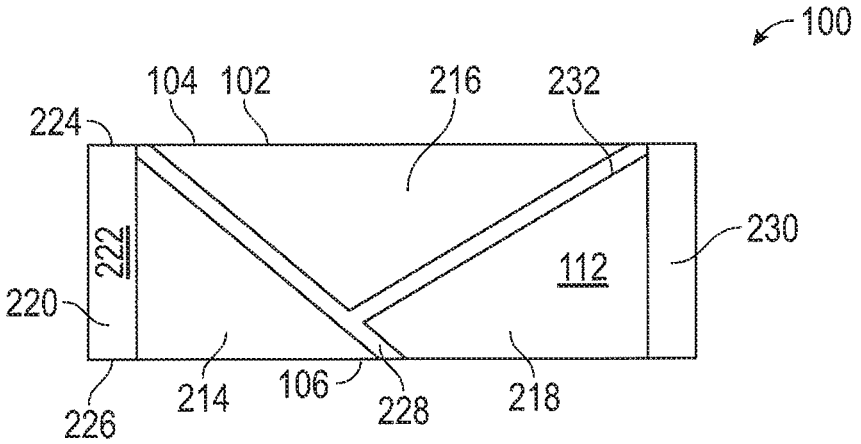
FIG. 2 illustrates an end view of an alternative joint seal system according to the present disclosure with packaging body.
Figure 4:
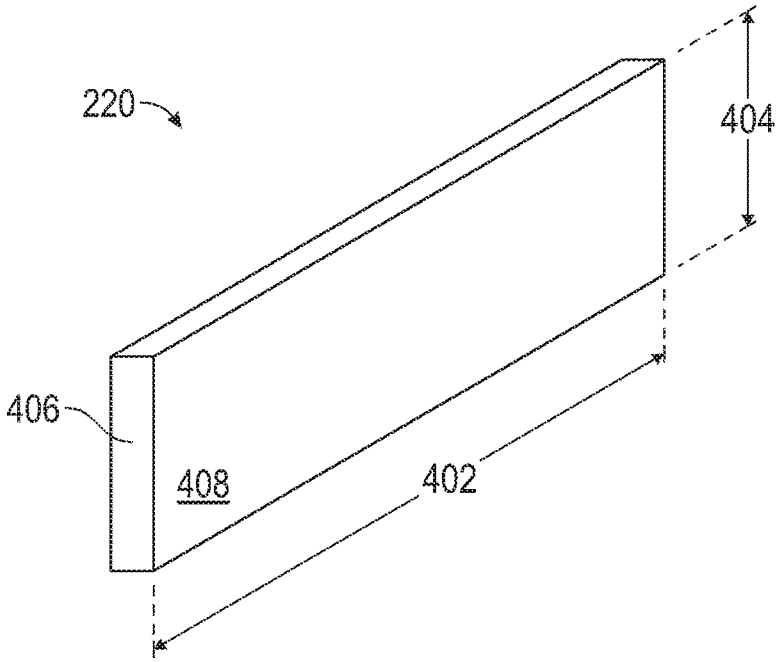
FIG. 4 illustrates a packaging body according to the present disclosure.

Referring to FIG. 2, an illustration is provided of an end view of an alternative joint seal system according to the present disclosure with packaging body. The thin, flexible non-foam member 232 may include one or more extensions 228 and need not be a single vee shape. The extension 228 provides a knee or other capturing shape for one of the prism members 214, 216, 218. The plurality of prism members includes a first triangular prism member 214 and a second triangular prism member 216, and an irregular quadrilateral polygonal prism member 218. A packaging body 220 may be included with the expansion joint seal 100, such as against the rectangular prism body first side surface 108 and/or the rectangular prism body second side surface 110. Referring to Fig. and to FIG. 4, an isometric illustration of a packaging body according to the present disclosure, the packaging body 220 may have a packaging body length 402 and a packaging body height 404. The packaging body 220 may have a packaging body length 402 from a packaging body front surface 222 to a packaging body rear surface 406, the packaging body length 402 equal to the first body length 522. The packaging body 220 may have a packaging body height 404 from a packaging body top surface 224 to a packaging body bottom surface 226, the packaging body height 404 equal to the first body height 120. The packaging body may have a packaging body first surface 408 from the packaging body top surface 224 to the packaging body bottom surface 226 and from the packaging body front surface 222 to the packaging body rear surface 406, the packaging body first surface 408 in contact with the rectangular prism body first side surface 108.

The packaging body 220 may be adhered to the rectangular prism body 102 and the thin, flexible non-foam member 232 or may be resistant to any adhesive on the rectangular prism body 102. The packaging body 220 may be provided with a surface the prism members 214, 216, 218 and the thin, flexible non-foam member 232 which deters adhesion to facilitate later removal from the packaging for installation between substrates.

The expansion joint seal 100 is provided in pre-compressed form for installation. The packaging body 220, the rectangular prism body 102 and the thin, flexible non-foam member 232 are subjected to laterally compression, such that the rectangular prism body width 122 is reduced. The expansion joint seal 100 is then packaged, such as in shrink wrap, to remain in compression. The packaging body 220 provides a rigid surface against which the the rectangular prism body 102 is maintained in compression. Prior to compression, the rectangular prism body 102 is wider than the nominal size of the expansion joint. After the expansion joint seal 100 is removed from packaging and separated from the packaging body 220, it is imposed between the first substrate and the second substrate before the rectangular prism body 102 relaxes to a width greater than the expansion joint. The rectangular prism body 102 continues to relax and contacts the substrate walls and is maintained in compression in the joint, and, by virtue of its nature, inhibits the transmission of water or other contaminants further into the expansion joint. The rectangular prism body 102 may be adhered to the substrate walls by an adhesive on the sides of the core bodies. Thus, the joint system may include the first substrate and the second substrate.

Because the rectangular prism body 102 is in compression between the substrates of an expansion joint, it is well-known to pre-compress the rectangular prism body 102 at the factory and provide the rectangular prism body 102 in compression.

When desired, a second packaging body 230, sized the same or similar to the first packaging body 220 may be used, and may provide benefit in compression and packaging of the joint seal 101. The second packaging body 230 abuts the rectangular prism body 102 at the rectangular prism body second side surface 110. The second packaging body 230 may be provided with a surface facing the rectangular prism body 102 which deters adhesion to facilitate later removal from the packaging for installation between substrates.

Figure 3:
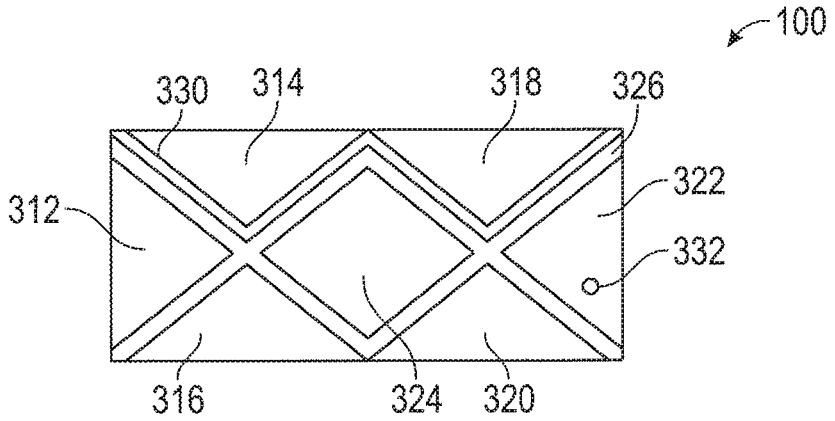
FIG. 3 illustrates an end view of another alternative joint seal system according to the present disclosure.

Referring to FIG. 3, an end view of another alternative joint seal system according to the present disclosure is illustrated. When desired, the thin, flexible non-foam member 326 may include one or more internal openings, in which a prism member may be imposed, and may include a number of triangular openings in which prism members may be imposed. Alternatively, any shapes may be provided, including polygons, cylindrical sections and even conic sections. As illustrated in FIG. 3, the plurality of prism members includes a quadrilateral prism member 324, a first triangular prism member 312 opposite the non-foam member 326 from the quadrilateral prism member 324, a second triangular prism member 314 opposite the non-foam member 326 from the first triangular prism member 212 and opposite the non-foam member 326 from the quadrilateral prism member 324, a third triangular prism member 316 opposite the non-foam member 326 from the first triangular prism member 212 and opposite the non-foam member 326 from the quadrilateral prism member 324, a fourth triangular prism member 318 opposite the non-foam member 326 from the quadrilateral prism member 324, a fifth triangular prism member 320 opposite the non-foam member 326 from the quadrilateral prism member 324, and opposite the non-foam member 326 from the fourth triangular prism member 318, a sixth triangular prism member 322 opposite the non-foam member 326 from the quadrilateral prism member 324, and opposite the non-foam member 326 from the fourth triangular prism member 318, and opposite the non-foam member 326 from the fifth triangular prism member 320, and the non-foam member 326 may have a non-foam member internal void at a center, two non-foam member legs at a non-foam member first end and two non-foam member legs at a non-foam member second end.

Alternatively, one or more openings in the non-foam member 326 may remain open. When desired, the expansion joint seal 100 includes a first triangular prism member 312, a second triangular prism member 314 opposite the non-foam member 326 from the first triangular prism member 212, a third triangular prism member 316 opposite the non-foam member 326 from the first triangular prism member 212 and opposite the non-foam member 326 from the second triangular prism member 314, a fourth triangular prism member 318 opposite the non-foam member 326 from the second triangular prism member 314, a fifth triangular prism member 320 opposite the non-foam member 326 from the quadrilateral prism member 324, and opposite the non-foam member 326 from the fourth triangular prism member 318, a sixth triangular prism member 322 opposite the non-foam member 326 from the fourth triangular prism member 318, and opposite the non-foam member 326 from the fifth triangular prism member 320, and the non-foam member 326 may have a non-foam member internal void at a center, two non-foam member legs at a non-foam member first end and two non-foam member legs at a non-foam member second end.

When the prism members 114, 116, 118, 214, 216, 218, 312, 314, 318, 320, 322, 324 are constructed of foam, any of various types of foam known in the art may be used, including compositions such as polyurethane and polystyrene, and may be open or closed cell. The uncompressed density of a prism member 114, 116, 118, 214, 216, 218, 312, 314, 318, 320, 322, 324 may also be altered for performance, depending on local weather conditions. The composition of each prism member 114, 116, 118, 214, 216, 218, 312, 314, 318, 320, 322, 324 need not be identical to another. A prism member 114, 116, 118, 214, 216, 218, 312, 314, 318, 320, 322, 324, for example, may be selected of a composition which is fire retardant or water-resistant. Moreover, when the prism members 114, 116, 118, 214, 216, 218, 312, 314, 318, 320, 322, 324 are constructed of foam(s), these may be any of an open cell foam, a lamination of open cell foam and closed cell foam, and closed cell foam. Further any of the prism members 114, 116, 118, 214, 216, 218, 312, 314, 318, 320, 322, 324 may have a treatment, such as impregnation, to increase desirable properties, such as fire resistance or water resistance, by, respectively, the introduction of a fire retardant into the foam or the introduction of a water inhibitor into the foam. Additionally, any of the prism members 114, 116, 118, 214, 216, 218, 312, 314, 318, 320, 322, 324 may be composed of or may include a hydrophilic material, a hydrophobic material, a fire-retardant material, or a sintering material.

Moreover, the material for the prism members 114, 116, 118, 214, 216, 218, 312, 314, 318, 320, 322, 324 may be selected from partially closed cell or viscoelastic foams. Most prior art foams seals have been designed as "soft foam" pre-compressed foam seals utilizing low to medium density foam (about 16-30 kg/m$^3$) and softer foam (ILD range of about 10-20). It has been surprisingly found through extensive testing of variations of foam densities and foam hardness, fillers and elastic impregnation compounds that higher density "hard" foams with high ILD's can provide an effective foam seal meeting the required waterproofing (600 Pa minimum and ideally 1000 Pa or greater) and movement and cycling requirements such as ASTM E-1399 Standard Test Method for Cyclic Movement and Measuring the Minimum and Maximum Joint Widths of Architectural Joint Systems as well as long term joint cycling testing. An advantage has been found in using higher density and higher hardness (higher ILD) foams particularly in horizontal applications. While at first this might seem obvious it is known in the art that higher density foams that are about 32-50 kg/m$^3$ with an ILD rating of about 40 and greater tend to have other undesirable properties such as a long term decrease in fatigue resistance. Desirable properties such as elongation, ability to resist compression set, foam resiliency and fatigue resistance typically decline relative to an increase in density and ILD. These undesirable characteristics are often more pronounced when fillers such as calcium carbonate, melamine and others are utilized to increase the foam density yet the cost advantage of the filled foam is beneficial and desirable. Similarly, when graft polyols are used in the manufacture of the base foam to increase the hardness or load carrying capabilities, other desirable characteristics of the base foam such as resiliency and resistance to compression set can be diminished. Through the testing of non-conventional impregnation binders and elastomers for pre-compressed foam sealants such as silicones, urethanes, polyureas, epoxies, and the like, it has been found that materials that have reduced tack or adhesive properties after cure and which provide a high internal recovery force can be used to counteract the long term fatigue resistance of the high density, high ILD foams. Further, it has been found that by first impregnating and curing the foam with the injected or impregnated silicone, acrylic, urethane or other low tack polymers and, ideally, elastomers with about 100-200% elongation or greater providing a sufficient internal recovery force, that it was additionally advantageous to re-impregnate the foam with another elastomer or binder to provide a timed expansion recovery at specific temperatures. The impregnation materials with higher long-term recovery capabilities imparted to the high density, high ILD base foams, such as a silicone or urethane elastomers, can be used to impart color to the foam seal or be a clear or translucent color to retain the base foam color. If desirable a second impregnation, partial impregnation or coating can be applied to or into the foam seal to add additional functional characteristics such as UV stability, mold and mildew resistance, color, fire-resistance or fire-ratings or other properties deemed desirable to functionality to the foam.

Viscoelastic foams have not typically been commercially available or used for foam seals due to perceived shortcomings. Commonly used formulations, ratios and methods do not provide a commercially viable foam seal using viscoelastic foam when compared to standard polyurethane foams. Open cell viscoelastic foams are more expensive than polyester or polyether polyurethane foams commonly used in foam seals. Any impregnation process on a viscoelastic foam tends to proceed slower than on a traditional foam due to the fine cell structure of viscoelastic foam. This can be particularly frustrating as the impregnation materials and the impregnation process are typically the most expensive component of a foam seal. However, because of their higher initial density viscoelastic foams can provide better load carrying or pressure resistant foam seal. Both properties are desirable but not fully provided for in the current art for use in applications such as load carrying horizontal joints or expansion joints for secondary containment. Common densities found in viscoelastic foams are 64-80 kg/m$^3$ or greater. Additionally, viscoelastic foams have four functional properties (density, ILD rating, temperature and time) compared to flexible polyurethane foams, which have two primary properties (density and an ILD rating).

However, the speed of recovery of viscoelastic foams following compression may be increased by reducing or eliminating any impregnation, surface impregnation or low adhesive strength impregnation compound. Incorporating fillers into the impregnation compound is known to be effective in controlling the adhesive strength of the impregnation binder and therefore the re-expansion rate of the impregnated foam. By surface impregnating or coating the outside surface of one or both sides of viscoelastic foam to approximately 10% of the foam thickness, such as about 3-8 mm deep for conventional joint seals, the release time can be controlled and predicted based on ambient temperature. Alternatively, the foam can be infused, partially impregnated or impregnated with a functional or non-functional filler without a using binder but rather only a solvent or water as the impregnation carrier where the carrier evaporates leaving only the filler in the foam.

The re-expansion rate of a seal using viscoelastic foam may be controlled by using un-impregnated viscoelastic foam strips and re-adhering them with a pressure sensitive adhesive or hot melt adhesive. When the seal is compressed, the laminating adhesive serves as a temporary restriction to re-expansion allowing time to install the foam seal. Viscoelastic foam may be advantageously used, rather than standard polyurethane foam, for joints requiring additional softness and flexibility due to higher foam seal compression in hot climates or exposure or increased stiffness in cold temperatures when a foam seal is at tis minimum compressed density. Additionally, close cell, partially closed cell and other foams can be used as in combination with the viscoelastic foams to reduce the overall cost.

This second group of body materials, the non-foam members, may include, for example, corrugated cardboards, natural and man-made batting materials, and natural, synthetic and man-made sponge material. When desired, such materials may be selected for properties, such as water leakage, an leakage, resilience in face of one or more cycling regimes, compressibility, relaxation rate, compression set, and elasticity.

The material for one or more of the prism members 114, 116, 118, 214, 216, 218, 312, 314, 318, 320, 322, 324 may be altered to provide additional functional characteristics. It may be infused, impregnated, partially impregnated or coated with an impregnation material or binder that is designed specifically to provide state of the art seal water-resistance properties with a uniform and consistent distribution of the waterproofing binder. One or more of the prism members 114, 116, 118, 214, 216, 218, 312, 314, 318, 320, 322, 324 may also, or alternatively, be infused or impregnated or otherwise altered to retain a fire retardant, dependent on function. Where the any of the prism members 114, 116, 118, 214, 216, 218, 312, 314, 318, 320, 322, 324 is foam, any suitable open cell form type with a density of 16-45 kg/m$^3$ or higher can provide an effective water-resistant foam-based seal by varying the impregnation density or the final compression ratio. Where a sound resistant seal is desired, the density or the variable densities provide a sound resistant seal in a similarly-rated wall from a Sound Transmission Class value from 42-63 and/or a sound reduction between 12 and 50 decibels.

One or more of the prism members 114, 116, 118, 214, 216, 218, 312, 314, 318, 320, 322, 324 may be selected from an inherently hydrophilic material or have a hydrophilic component such as a hydrophilic polymer that is uniformly distributed throughout. One or more of the prism members 114, 116, 118, 214, 216, 218, 312, 314, 318, 320, 322, 324 are constructed of foam may include strategically-placed surface impregnation or partially impregnate with a hydroactive polymer. Because the primary function of the prism members 114, 116, 118, 214, 216, 218, 312, 314, 318, 320, 322, 324 is waterproofing, the addition of a hydrophilic function does not negatively impact any desired fire-resistant properties, as an increased moisture content in any of the prism members 114, 116, 118, 214, 216, 218, 312, 314, 318, 320, 322, 324 are constructed of foam may increase fire resistive properties.

One or more of the prism members 114, 116, 118, 214, 216, 218, 312, 314, 318, 320, 322, 324 could be formed of commercially available vapor permeable foam products or by forming specialty foams. Commercial available products which provide vapor permeable and excellent fire-resistant properties are well known, such as Sealtite VP or Willseal 600. It is well known that a vapor permeable but water-resistant foam joint sealant may be produced leaving at least a portion of the cell structure open while in compression such that water vapor can escape through the impregnated foam sealant. Water is then ejected on the exterior of the prism members 114, 116, 118, 214, 216, 218, 312, 314, 318, 320, 322, 324 because the foam, and/or any impregnation, is hydrophobic and therefore repels water. Water can escape from the foam sealant or wall cavity through water vapor pressure by virtue of the difference in humidity creating unequal pressure between the two areas. Because the cell structure is still partially open the vapor pressure drive is sufficient to allow moisture to return to equalization or the exterior of the structure. By a combination of compression ratio and impregnation density of a hydrophobic component the water resistance capacity can be increased to provide resistance to various levels of pressure or driving rain.

One or more of the prism members 114, 116, 118, 214, 216, 218, 312, 314, 318, 320, 322, 324 may include an impregnate, such as a fire retardant such as aluminum trihydroxide, which may be throughout its entirety or for a desired depth from the surface. Additional function properties can be added by surface impregnating the exposed or outside surfaces of the foam as well as the inside portion if additional properties are desirable.

Beneficially, where fire retardancy is provided by first fire-retardant coating 130 and/or non-foam member 124, 232, 326, the present disclosure provides for an expansion joint sealant without the need to impregnate one or all of the prism members 114, 116, 118, 214, 216, 218, 312, 314, 318, 320, 322, 324 with a fire retardant.

An adhesive may be applied to the rectangular prism body first side surface 108 and/or rectangular prism body second side surface 110.

The one or all of the prism members 114, 116, 118, 214, 216, 218, 312, 314, 318, 320, 322, 324 may contain, such as by impregnation or infusion, a sintering material, wherein the particles in the impregnate move past one another with minimal effort at ambient temperature but form a solid upon heating. Once such sintering material is clay or a nano-clay. Such as sintering impregnate would provide an increased overall insulation value and permit a lower density at installation than conventional foams while still having a fire endurance capacity of at least one hour, such as in connection with the UL 2079 standard for horizontal and vertical joints. While the cell structure, particularly, but not solely, when compressed, of one or all of the prism members 114, 116, 118, 214, 216, 218, 312, 314, 318, 320, 322, 324 preferably inhibits the flow of water, the presence of an inhibitant or a fire retardant may prove additionally beneficial. The fire retardant may be introduced as part of the foaming process, or by impregnating, coating, infusing, or laminating, or by other processes known in the art.

The expansion joint seal 100 may further include an insulating layer 132, such as a silicate, atop the first fire-retardant coating 130 to add a refractory of insulating function. However, such a layer, unless otherwise selected, would not be a fire-retardant liquid glass formulation.

The exposed top surface may be coated or partially coated with a flexible or semi-rigid elastomer to increase load carrying capability which is further enhanced by the supporting intumescent members. These, or other coatings, may be used to provide waterproofing, fire resistance, or additional functional benefits.

Other variations may be employed. Referring to FIG. 3, the present disclosure may further incorporate a membrane 330, such as vapor impermeable layer, for further benefits. The membrane 330 may be positioned at the top or bottom surface of the rectangular prism body 102 are not susceptible to contaminants and therefore continue to function. As one or more prism members 114, 116, 118, 214, 216, 218, 312, 314, 318, 320, 322, 324 may be composed of a vapor permeable foam, such a composition becomes particularly beneficial when a barrier or membrane 330 is present. The membrane 330 may thus may retain and then expel moisture, preventing moisture from penetrating in an adjacent substrate. As can be appreciated, to be effective, the membrane 330 is preferably sized to be no smaller in any dimension than the adjacent core body. Alternatively, the membrane 330 may extend beyond the core bodies to provide a surface which may contact an adjacent substrate and even overlap its top. The membrane 330 may be intumescent or may otherwise provide fire retardancy in the expansion join seal 100. Consistent with uses known in the art, the present disclosure may be associated with a central non-conductive spine and cover plate assembly for those uses wherein high traffic is anticipated, as well as for compliance with Department of Transportation requirements. The present invention may be adapted for use with other expansion joint systems, such those that incorporate a rib or spline within or connection to a body such as core bodies and attached or associated, permanently or detachably with a cover plate.

The expansion joint seal 100 may be constructed to withstand a hydrostatic pressure equal to or greater than 29.39 psi. Environmentally friendly foam, filler, binders, elastomer and other components may be selected to meet environmental, green and energy efficiency standards. One or more of the prism members 114, 116, 118, 214, 216, 218, 312, 314, 318, 320, 322, 324 may exhibit auxetic properties to provide support or stability for the expansion joint seal 100 as it thermally cycles or to provide additional transfer loading capacity. Auxetic properties may be provided by the body material, the internal components such as the members/membrane or by an external mechanical mechanism. One or more of prism members 114, 116, 118, 214, 216, 218, 312, 314, 318, 320, 322, 324 may have a rigid or semi-rigid central core equal to 5-65% of rectangular prism body width 122. One or more of the prism members 114, 116, 118, 214, 216, 218, 312, 314, 318, 320, 322, 324 may have a central core rigid through normal joint cycling, typically +/−25%, but collapsible under seismic (+/−50%) joint cycling. One or more of the prism members 114, 116, 118, 214, 216, 218, 312, 314, 318, 320, 322, 324 may have a central core both rigid and collapsible and coupled with a data feedback system where sensors collect data and supplies information to be stored internally or externally.

Additionally, when desired, a sensor 332 may be included and may contact one of more of the component of the expansion joint seal 100. The sensor may be a radio frequency identification device (RFID), transponder, or other wirelessly transmitting sensor. A sensor may be beneficial to assess the health of an expansion joint seal 100 without accessing the interior of the expansion joint, otherwise accomplished by removal of the cover plate. It may identify when a failure occurs and thus provide an integral failure detection system. The failure detection system may be continuously or intermittently monitored and may provide feedback by powered, radio or inductive methods which may have an active or passive feedback system. It may alternatively provide environmental data, including air or water contamination. Such sensors are known in the art, and which may provide identification of circumstances such as moisture penetration and accumulation. The inclusion of a sensor in the expansion joint seal 100 may be particularly advantageous in circumstances where the expansion joint seal 100 is concealed after installation, particularly as moisture sources and penetration may not be visually detected. Thus, by including a low cost, moisture-activated or sensitive sensor at the rectangular prism body bottom surface 106, the user can scan the expansion joint seal 100 for any points of weakness due to water penetration. A heat sensitive sensor may also be positioned within the expansion joint seal 100, thus permitting identification of actual internal temperature, or identification of temperature conditions requiring attention, such as increased temperature due to the presence of fire, external to the joint or even behind it, such as within a wall. Such data may be particularly beneficial in roof and below grade installations where water penetration is to be detected as soon as possible.

Inclusion of a sensor in rectangular prism body 102 may provide substantial benefit for information feedback and potentially activating alarms or other functions within the joint seal 101 or external systems. Fires that start in curtain walls are catastrophic. High and low-pressure changes have deleterious effects on the long-term structure and the connecting features. Providing real time feedback and potential for data collection from sensors, particularly given the inexpensive cost of such sensors, in those areas and particularly where the wind, rain and pressure will have their greatest impact would provide benefit. While the pressure on the wall is difficult to measure, for example, the deflection in a pre-compressed sealant is quite rapid and linear. Additionally, joint seals are used in interior structures including but not limited to bio-safety and cleanrooms. Additionally, a sensor could be selected which would provide details pertinent to the state of the Leadership in Energy and Environmental Design (LEED) efficiency of the building. Additionally, such a sensor, which could identify and transmit air pressure differential data, could be used in connection with masonry wall designs that have cavity walls or in the curtain wall application, where the air pressure differential inside the cavity wall or behind the cavity wall is critical to maintaining the function of the system. A sensor may be positioned in other locations within the joint seal 101 to provide beneficial data. A sensor may be positioned within the rectangular prism body 102 to provide prompt notice of detection of heat outside typical operating parameters, so as to indicate potential fire or safety issues. Such a positioning would be advantageous in horizontal of confined areas. A sensor so positioned might alternatively be selected to provide moisture penetration data, beneficial in cases of failure or conditions beyond design parameters. The sensor may provide data on moisture content, heat or temperature, moisture penetration, and manufacturing details. A sensor may provide notice of exposure from the surface of the expansion joint seal 100 most distant from the base of the joint. A sensor may further provide real time data. Using a moisture sensitive sensor in the expansion joint seal 100 and at critical junctions/connections would allow for active feedback on the waterproofing performance of the expansion joint seal 100. It can also allow for routine verification of the watertightness with a hand-held sensor reader to find leaks before the reach occupied space and to find the source of an existing leak. Often water appears in a location much different than it originates making it difficult to isolate the area causing the leak. A positive reading from the sensor alters the property owner to the exact location(s) that have water penetration without or before destructive means of finding the source. The use of a sensor in the expansion joint seal 100 is not limited to identifying water intrusion but also fire, heat loss, air loss, break in joint continuity and other functions that cannot be checked by non-destructive means. Use of a sensor within expansion joint seal 100 may provide a benefit over the prior art. Impregnated foam materials are known to cure fastest at exposed surfaces, encapsulating moisture remaining inside the body, and creating difficulties in permitting the removal of moisture from within the body. While heating is a known method to addressing these differences in the natural rate of cooling, it unfortunately may cause degradation of the foam in response. Similarly, while forcing air through the foam bodies may be used to address the curing issues, the potential random cell size and structure impedes airflow and impedes predictable results. Addressing the variation in curing is desirable as variations affect quality and performance properties. The use of a sensor within expansion joint seal 100 may permit use of the heating method while minimizing negative effects. The data from the sensors, such as real-time feedback from the heat, moisture and air pressure sensors, aids in production of a consistent product. Moisture and heat sensitive sensors aid in determining and/or maintaining optimal impregnation densities, airflow properties of the foam during the curing cycle of the foam impregnation. Placement of the sensors into foam at the pre-determined different levels allows for optimum curing allowing for real time changes to temperature, speed and airflow resulting in increased production rates, product quality and traceability of the input variables to that are used to accommodate environmental and raw material changes for each product lots.

The selection of components providing resiliency, compressibility, water-resistance and fire resistance, the joint seal 101 may be constructed to provide sufficient characteristics to obtain fire certification under any of the many standards available. In the United States, these include ASTM International's E 814 and its parallel Underwriter Laboratories UL 1379 "Fire Tests of Through-penetration Firestops," ASTM International's E1966 and its parallel Underwriter Laboratories UL 2079 "Tests for Fire-Resistance Joint Systems," ASTM International's E 2307 "Standard Test Method for Determining Fire Resistance of Perimeter Fire Barrier Systems Using Intermediate-Scale, Multistory Test Apparatus, the tests known as ASTM E 84, UL 723 and NFPA 255 "Surface Burning Characteristics of Building Materials," ASTM E 90 "Standard Practice for Use of Sealants in Acoustical Applications," ASTM E 119 and its parallel UL 263 "Fire Tests of Building Construction and Materials," ASTM E 136 "Behavior of Materials in a Vertical Tube Furnace at 750° C." (Combustibility), ASTM E 1399 "Tests for Cyclic Movement of Joints," ASTM 595 "Tests for Outgassing in a Vacuum Environment," ASTM G 21 "Determining Resistance of Synthetic Polymeric Materials to Fungi." Some of these test standards are used in particular applications where firestop is to be installed.

Most of these use the Cellulosic time/temperature curve, described by the known equation T=20+345*LOG(8*t+1) where t is time, in minutes, and T is temperature in degrees Celsius including E 814/UL 1379 and E 1966/UL 2079.

E 814/UL 1379 tests a fire-retardant system for fire exposure, temperature change, and resilience and structural integrity after fire exposure (the latter is generally identified as "the Hose Stream test"). Fire exposure, resulting in an F [Time] rating, identifies the time duration—rounded down to the last completed hour, along the Cellulosic curve before flame penetrates through the body of the system, provided the system also passes the hose stream test. Common F ratings include 1, 2, 3 and 4 hours but up to 8 hours may be required. Temperature change, resulting in a T [Time] rating, identifies the time for the temperature of the unexposed surface of the system, or any penetrating object, to rise 181° C. above its initial temperature, as measured at the beginning of the test. The rating is intended to represent how long it will take before a combustible item on the non-fireside will catch on fire from heat transfer. In order for a system to obtain a UL 1379 listing, it must pass both the fire endurance (P rating) and the Hose Stream teat. The temperature data is only relevant where building codes require the T to equal the P-rating.

When required, the Hose Steam test is performed after the fire exposure test is completed. In some tests, such as UL 2079, the Hose Stream test is required with wall-to-wall and head-of-wall joints, but not others. This test assesses structural stability following fire exposure as fire exposure may affect air pressure and debris striking the fire-resistant system. The Hose Stream uses a stream of water. The stream is to be delivered through a 64 mm hose and discharged through a National Standard playpipe of corresponding size equipped with a 29 mm discharge tip of the standard-taper, smooth-bore pattern without a shoulder at the orifice consistent with a fixed set of requirements:

| Hourly Fire Rating Time in Minutes | Water Pressure (kPa) | Duration of Hose Stream Test (sec./m$^2$) |
|---|---|---|
| 240 ≤ time < 480 | 310 | 32 |
| 120 ≤ time < 240 | 210 | 16 |
| 90 ≤ time < 120 | 210 | 9.7 |
| time < 90 | 210 | 6.5 |

The nozzle orifice is to be 6.1 m from the center of the exposed surface of the joint system if the nozzle is so located that, when directed at the center, its axis is normal to the surface of the joint system. If the nozzle is unable to be so located, it shall be on a line deviating not more than 30° from the line normal to the center of the joint system. When so located its distance from the center of the joint system is to be less than 6.1 m by an amount equal to 305 mm for each 10° of deviation from the normal. Some test systems, including UL 1379 and UL 2079 also provide for air leakage and water leakage tests, where the rating is made in conjunction with a L and W standard. These further ratings, while optional, are intended to better identify the performance of the system under fire conditions.

When desired, the Air Leakage Test, which produces an L rating and which represents the measure of air leakage through a system prior to fire endurance testing, may be conducted. The L rating is not pass/fail, but rather merely a system property. For Leakage Rating test, air movement through the system at ambient temperature is measured. A second measurement is made after the air temperature in the chamber is increased so that it reaches 177° C. within 15 minutes and 204° C. within 30 minutes. When stabilized at the prescribed air temperature of 204±5° C., the air flow through the air flow metering system and the test pressure difference are to be measured and recorded. The barometric pressure, temperature and relative humidity of the supply air are also measured and recorded. The air supply flow values are corrected to standard temperature and pressure (STP) conditions for calculation and reporting purposes. The air leakage through the joint system at each temperature exposure is then expressed as the difference between the total metered air flow and the extraneous chamber leakage. The air leakage rate through the joint system is the quotient of the air leakage divided by the overall length of the joint system in the test assembly.

When desired, the Water Leakage Test produces a W pass-fail rating and which represents an assessment of the watertightness of the system, can be conducted. The test chamber for or the test consists of a well-sealed vessel sufficient to maintain pressure with one open side against which the system is sealed and wherein water can be placed in the container. Since the system will be placed in the test container, its width must be equal to or greater than the exposed length of the system. For the test, the test fixture is within a range of 10 to 32° C. and chamber is sealed to the test sample. Nonhardening mastic compounds, pressure-sensitive tape or rubber gaskets with clamping devices may be used to seal the water leakage test chamber to the test assembly. Thereafter, water, with a permanent dye, is placed in the water leakage test chamber sufficient to cover the systems to a minimum depth of 152 mm. The top of the joint system is sealed by whatever means necessary when the top of the joint system is immersed under water and to prevent passage of water into the joint system. The minimum pressure within the water leakage test chamber shall be 1.3 psi applied for a minimum of 72 hours. The pressure head is measured at the horizontal plane at the top of the water seal. When the test method requires a pressure head greater than that provided by the water inside the water leakage test chamber, the water leakage test chamber is pressurized using pneumatic or hydrostatic pressure. Below the system, a white indicating medium is placed immediately below the system. The leakage of water through the system is denoted by the presence of water or dye on the indicating media or on the underside of the test sample. The system passes if the dyed water does not contact the white medium or the underside of the system during the 72-hour assessment.

Another frequently encountered classification is ASTM E-84 (also found as UL 723 and NFPA 255), Surface Burning Characteristics of Burning Materials. A surface burn test identifies the flame spread and smoke development within the classification system. The lower a rating classification, the better fire protection afforded by the system. These classifications are determined as follows:

| Classification | Flame Spread | Smoke Developement |
|---|---|---|
| A | 0-25 | 0-450 |
| B | 26-75 | 0-450 |
| C | 76-200 | 0-450 |

UL 2079, Tests for Fire Resistant of Building Joint Systems, comprises a series of tests for assessment for fire resistive building joint system that do not contain other unprotected openings, such as windows and incorporates four different cycling test standards, a fire endurance test for the system, the Hose Stream test for certain systems and the optional air leakage and water leakage tests. This standard is used to evaluate floor-to-floor, floor-to-wall, wall-to-wall and top-of-wall (head-of-wall) joints for fire-rated construction. As with ASTM E-814, UL 2079 and E-1966 provide, in connection with the fire endurance tests, use of the Cellulosic Curve. UL 2079/E-1966 provides for a rating to the assembly, rather than the convention F and T ratings. Before being subject to the Fire Endurance Test, the same as provided above, the system is subjected to its intended range of movement, which may be none. These classifications are:

| Movement Classification (if used) | Minimum number of cycles | Mimimum cycling rate (cycles per minute) | Joint Type (if used) |
|---|---|---|---|
| No Classification | 0 | 0 | Static |
| Class I | 500 | 1 | Thermal Expansion/ Contraction |
| Class II | 500 | 10 | Wind Sway |
| Class III | 100 | 30 | Seismic |
| | 400 | 10 | Combination |

ASTM E 2307, Standard Test Method for Determining Fire Resistance of Perimeter Fire Barrier Systems Using Intermediate-Scale, Multi-story Test Apparatus, is intended to test for a systems ability to impede vertical spread of fire from a floor of origin to that above through the perimeter joint, the joint installed between the exterior wall assembly and the floor assembly. A two-story test structure is used wherein the perimeter joint and wall assembly are exposed to an interior compartment fire and a flame plume from an exterior burner. Test results are generated in F-rating and T-rating. Cycling of the joint may be tested prior to the fire endurance test and an Air Leakage test may also be incorporated.

The expansion joint seal 100 may therefore perform wherein the bottom surface the rectangular prism body bottom surface 106 at a maximum joint width increases no more than 181° C. after sixty minutes when the body member 111 is exposed to heating according to the equation T=20+345*LOG(8*t+1), where t may be time in minutes and T may be temperature in C.

In expansion joint seal 100 may also perform wherein the rectangular prism body bottom surface 106, and may have a maximum joint width of more than six (6), increases no more than 139° C. after sixty minutes when the expansion joint seal 100 is exposed to heating according to the equation T=20+345*LOG(8*t+1), where t may be time in minutes and T may be temperature in C.

The expansion joint seal 100 may be adapted to be cycled one of 500 times at t cycle per minute, 500 times at 10 cycles per minute and cycles at 30 times per minute, without indication of stress, deformation or fatigue.

In other embodiments, the expansion joint seal 100 is configured to pass hurricane force testing to TAS 202/203. Further the expansion joint seal 100 may be designed or configured to pass ASTM E-282, E-331, E-330, E-547 or simile testing to meet the pressure cycling and water resistance requirements up to 5000 Pa or more.

As can be appreciated, the foregoing disclosure may incorporate or be incorporated into other expansion joint systems, such as those with fire-retardant members in a side of any of expansion joint seal 100 adjacent the substrate, the inclusion of a separate barrier within the expansion joint seal 100 and which may extend beyond the rectangular prism body first side surface 108 and the rectangular prism body second side surface 110 of the expansion joint seal 100 or remain encapsulated within, one or more longitudinal load transfer members atop or within any of the prism members 114, 116, 118, 214, 216, 218, 312, 314, 318, 320, 322, 324, without or without support members, a cover plate, a spline or ribs tied to the cover plate whether fixedly or detachably, use of auxetic materials, or constructed to obtain a fire endurance rating or approval according to any of the tests known in the United States and Europe for use with expansion joint systems, including fire endurance, movement classification(s), load bearing capacity, air penetration and water penetration.

The foregoing disclosure and description is illustrative and explanatory thereof. Various changes in the details of the illustrated construction may be made within the scope of the appended claims without departing from the spirit of the invention. The present invention should only be limited by the following claims and their legal equivalents.

The invention claimed is:

1. An expansion joint seal comprising:

an elastic and resilient rectangular prism body having a rectangular prism body top surface, a rectangular prism body bottom surface opposite the rectangular prism body top surface, a rectangular prism height from the rectangular prism body bottom surface to the rectangular prism body top surface, a rectangular prism body first side surface, a rectangular prism body second side surface opposite the rectangular prism body first side surface, a rectangular prism body width from the rectangular prism body second side surface to the rectangular prism body first side surface, a rectangular prism body front surface, a rectangular prism body rear surface opposite the rectangular prism body front surface, a rectangular prism body length from the rectangular prism body rear surface to the rectangular prism body front surface, the rectangular prism body having a plurality of prism members, each of the prism members having a prism body length equal to the rectangular prism body length, a prism body width less than the rectangular prism body width; and a thin, flexible non-foam member intermediate each of the plurality of nonrectangular prism members, the non-foam member having a non-foam member length rectangular prism body, the non-foam member adhered to each of the plurality of nonrectangular prism members.

2. The expansion joint seal of claim 1, wherein one of the prism members is not a rectangular prism.

3. The expansion joint seal of claim 1, wherein the non-foam member has a non-foam member thickness not greater than 10 percent of the rectangular prism body width.

4. The expansion joint seal of claim 1, wherein the non-foam member is composed of material selected from the group consisting of a permeable material, an impermeable material, a rubber material, a hydrophilic, a hydrophobic material, a fire-retardant material.

5. The expansion joint seal of claim 1, wherein the plurality of prism members includes a first triangular prism member and a second triangular prism member.

6. The expansion joint seal of claim 5, wherein the plurality of prism members includes a third prism member and the non-foam member includes a v-shaped profile.

7. The expansion joint seal of claim 1, wherein the wherein the plurality of prism members includes a first triangular prism member and a second triangular prism member, and an irregular quadrilateral polygonal prism member.

8. The expansion joint seal of claim 1, wherein the plurality of prism members includes a quadrilateral prism member, a first triangular prism member opposite the non-foam member from the quadrilateral prism member, a second triangular prism member opposite the non-foam member from the first triangular prism member and opposite the non-foam member from the quadrilateral prism member, a third triangular prism member opposite the non-foam member from the first triangular prism member and opposite the non-foam member from the quadrilateral prism member, a fourth triangular prism member opposite the non-foam member from the quadrilateral prism member, a fifth triangular prism member opposite the non-foam member from the quadrilateral prism member, and opposite the non-foam member from the fourth triangular prism member, a sixth triangular prism member opposite the non-foam member from the quadrilateral prism member, and opposite the non-foam member from the fourth triangular prism member, and opposite the non-foam member from the fifth triangular prism member, and the non-foam member having a non-foam member internal void at a center, two non-foam member legs at a non-foam member first end and two non-foam member legs at a non-foam member second end.

9. The expansion joint seal of claim 1, wherein a first prism member of the plurality of prism members has a first prism member density and a second prism member of the plurality of prism members has a second prism member density, the first prism member density and the second prism member density being unequal.

10. The expansion joint seal of claim 1, one of the plurality of prism members having internal voids in communication with at least one of a prism member first surface, a prism member second surface, a prism member bottom surface, a prism member top surface, a prism member front surface, and a prism member rear surface, at least one quarter of the internal voids having a fire-retardant material therein.

11. The expansion joint seal of claim 1, further comprising:

a packaging body, the packaging body having a packaging body length from a packaging body front surface to a packaging body rear surface, the packaging body length equal to the rectangular prism body length, a packaging body having a packaging body height from a packaging body top surface to a packaging body bottom surface, the packaging body height equal to the rectangular prism height, a packaging body first surface from the packaging body top surface to the packaging body bottom surface and from the packaging body front surface to the packaging body rear surface, the packaging body first surface in contact with the rectangular prism body first side surface.

12. The expansion joint seal of claim 1, wherein the non-foam member has a spring force.

13. The expansion joint seal of claim 1, wherein the plurality of prism members includes a first triangular prism member, a second triangular prism member opposite the non-foam member from the first triangular prism ember, a third triangular prism member opposite the non-foam member from the first triangular prism member and opposite the non-foam member from the second triangular prism member, a fourth triangular prism member opposite the non-foam member from the second triangular prism member, a fifth triangular prism member opposite the non-foam member from the quadrilateral prism member, and opposite the non-foam member from the fourth triangular prism member, a sixth triangular prism member opposite the non-foam member from the fourth triangular prism member, and opposite the non-foam member from the fifth triangular prism member, and the non-foam member having a non-foam member internal void at a center, two non-foam member legs at a non-foam member first end and two non-foam member legs at a non-foam member second end.

* * * * *